US007740744B2

(12) United States Patent
Van Winkle

(10) Patent No.: US 7,740,744 B2
(45) Date of Patent: Jun. 22, 2010

(54) METHOD AND APPARATUS FOR REMOVING RESIDUAL TISSUE FROM PARENT ROLLS

(75) Inventor: Richard C. Van Winkle, Astoria, OR (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 462 days.

(21) Appl. No.: 11/859,410

(22) Filed: Sep. 21, 2007

(65) Prior Publication Data

US 2009/0078387 A1 Mar. 26, 2009

(51) Int. Cl.
*D21G 3/00* (2006.01)

(52) U.S. Cl. ..... 162/272; 239/597; 239/455; 239/107; 118/63; 118/68

(58) Field of Classification Search ..... 162/272; 239/597, 455, 107, 1; 118/63, 68
See application file for complete search history.

(56) References Cited

U.S. PATENT DOCUMENTS 4,515,313 A * 5/1985 Cavanagh ..... 239/455
5,064,118 A * 11/1991 Lauricella ..... 239/1
5,074,242 A 12/1991 Bricmont
5,332,437 A * 7/1994 Davene et al. ..... 118/63
5,895,542 A 4/1999 Wadzinski
5,904,775 A 5/1999 Salo et al.
6,106,902 A 8/2000 Koskinen et al.
6,261,368 B1 7/2001 Wight
6,283,018 B1 9/2001 Dwiggins et al.
6,316,060 B1 11/2001 Elvidge et al.
6,726,770 B2 4/2004 Eichinger
6,869,639 B2 3/2005 Damrau et al.
6,893,682 B2 5/2005 Halmschlager et al.
7,461,797 B2 * 12/2008 Bhat ..... 239/597
7,563,322 B2 * 7/2009 Loth ..... 118/63
2002/0117575 A1 8/2002 Gilmore et al.
2007/0045461 A1 3/2007 Sartain et al.

* cited by examiner

*Primary Examiner*—Mark Halpern
(74) *Attorney, Agent, or Firm*—Laura L. Bozek

(57) ABSTRACT

Cellulosic based cores used in manufacture of towel and tissue products can be effectively stripped of residual product with little damage to the core using a roll stripping air knife with a longitudinal air passageway having both primary discharge passages and interconnected auxiliary orifices, the auxiliary orifices are directed laterally away from the primary discharge direction and connect with a longitudinal exterior channel configured such that air flows inwardly through the auxiliary orifices when pressurized air is supplied to longitudinal air passageway and the primary discharge passages are unobstructed but outwardly when the primary discharge passages are obstructed so that the pressure achievable when the primary discharge passages are obstructed is within safety limits.

12 Claims, 16 Drawing Sheets

SECTION A-A

METHOD AND APPARATUS FOR REMOVING RESIDUAL TISSUE FROM PARENT ROLLS

Manufacture of towel and tissue products for consumer products is usually conducted in two stages: papermaking and converting. In papermaking, wood pulp dispersed in water is applied to a moving foraminous support, free water drained and/or pressed therefrom and the residual water removed by drying. As papermachines operate at very high speed, often exceeding sixty miles per hour, the dried web is wound onto a core to form a parent roll from which it is later removed for converting which is usually a far slower operation. In many cases, the converting operation is unable to usefully employ all of the web found on the parent roll, particularly when two ply products are being formed. As it is desirable to be able to recycle the cores as many times as possible, the residual tissue on the roll is usually removed from the core prior to recycling.

At present, residual towel or tissue is typically removed either mechanically using a mechanical cutter or with an air wand which penetrates the paper. Mechanical removal usually results in scoring of the surface of the core while the maximum pressure that an air wand can apply is subject to stringent regulation for the safety of employees. Thus, both processes are relatively slow and/or inefficient. Further, as these cores are typically a very heavy paperboard cylindrical shell, scoring eventually renders the core unsuitable for re-use. Papermaking being most economically carried out on a huge scale, enterprises manufacturing towel and tissue products typically spend heavily on the cores used for parent rolls; so any improvement in the number of times that a core can be re-used can be quite significant economically. This invention relates to a method and apparatus for safely removing residual paper from the core at enhanced speed while reducing damage to the core thereby enhancing the number of times that a core may be re-used.

These goals can be effectively addressed using the multi-nozzle air-knife described herein which provides a roll stripping air knife comprising: a manifold block having an internal longitudinal air passageway defined therein; a working face having a longitudinally extending exterior channel formed therein; a plurality of discharge passages extending between the longitudinal air passageway and the longitudinally extending exterior channel and opening into the longitudinally extending exterior channel. Air supplied to the internal longitudinal air passageway exits through a plurality of primary discharge orifices defined in the manifold block extending in a longitudinal linear array extending along the length thereof, each primary discharge orifice connects with an associated discharge passage connecting with said longitudinal air passageway, each said orifice has means for mounting a removable air discharge nozzle thereupon, and each said primary discharge orifice is generally oriented and directed in a primary discharge direction. A plurality of interconnected auxiliary orifices are defined in the manifold block, each auxiliary orifice being generally directed laterally away from the primary discharge direction and connecting with the longitudinally extending exterior channel. A plurality of removable air nozzles are provided, one mounted on each primary discharge orifice; along with means for controllably supplying pressurized air to the manifold block. The auxiliary orifices are configured such that air flows inwardly therethrough when pressurized air is supplied to the manifold block and the nozzles are unobstructed but outwardly when the nozzles are obstructed. Preferred embodiments of the roll stripping air knife further comprise: a shield retractably mounted on and laterally encompassing the manifold over an angle which is at least about 150° as measured from the nozzles when the shield is retracted and at least about 210°, when the shield is extended, the shield having a generally U-shaped cross-section opening generally in the primary discharge direction.

DESCRIPTION OF A PREFERRED EMBODIMENT

Figure 1:
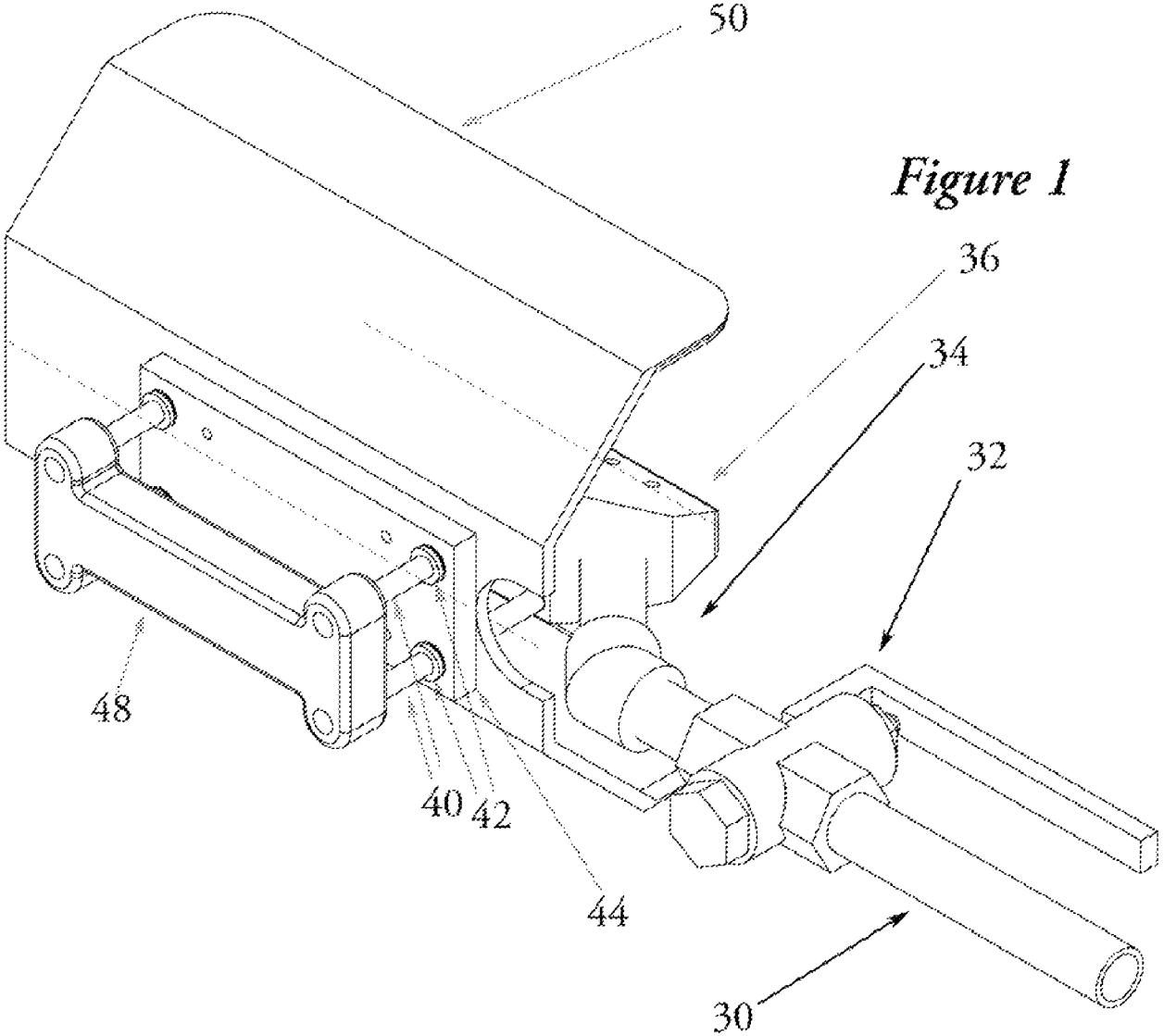
FIG. 1 is schematic isometric perspective illustrating the operator side of an air knife.

In FIGS. 1-4A, air flows through supply line 30, control valve 32 and offset fitting 34 into manifold block 36 of air knife 38. Manifold block 36 is joined to handle 48 by support rods 40 slidably passing through journals 42 on pillow block 44. Springs (not shown) surrounding support rods 40 yieldably urge handle 48 away from pillow block 44 bearing shield 50 retractably encompassing manifold block 36.

Figure 2:
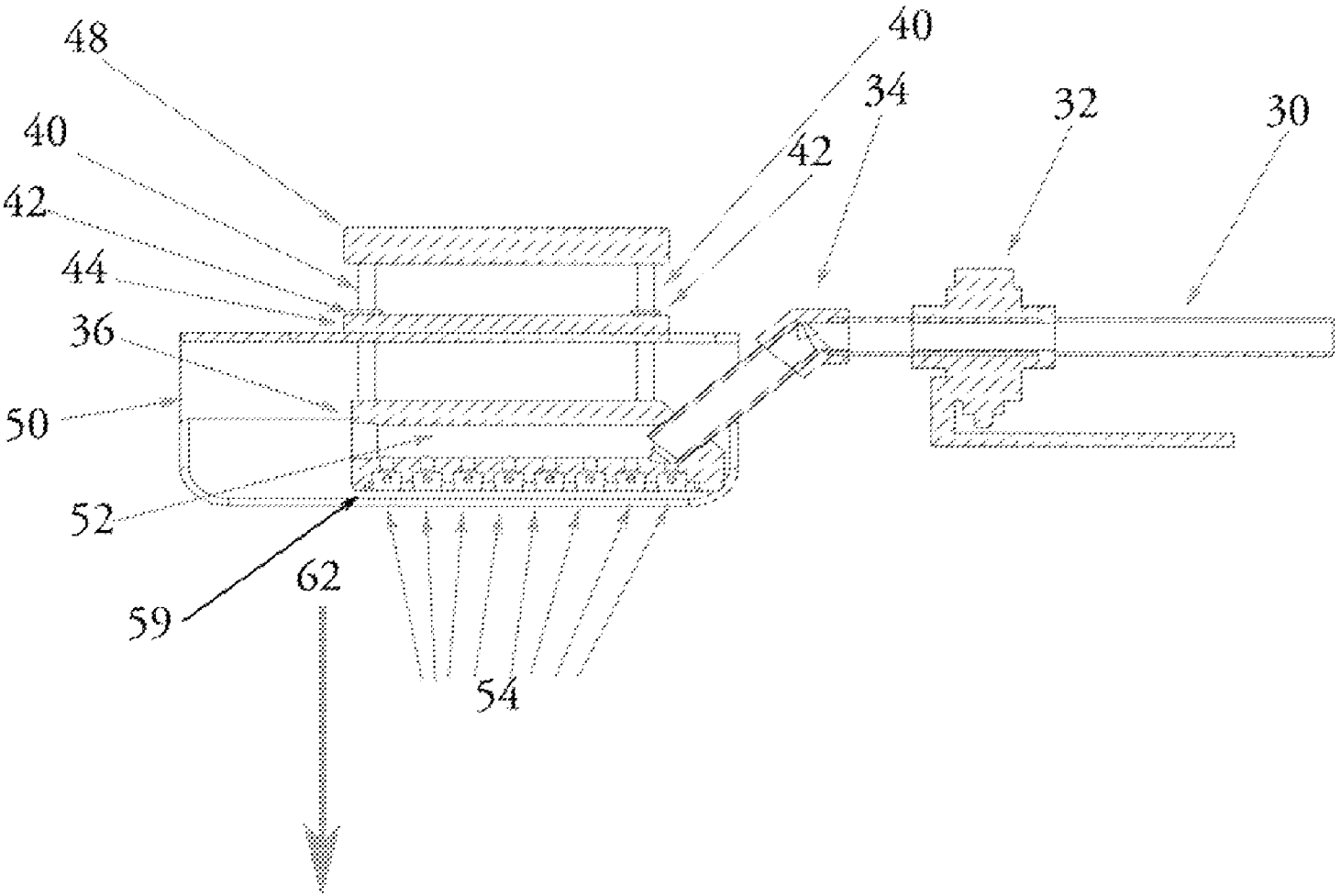
FIG. 2 is cross-sectional view of an air knife.

In FIG. 2, it can be appreciated that air from supply line 30 flows though control valve 32, offset fitting 34 into internal longitudinal passageway 52 in manifold block 36 and thence to primary discharge passages 54 extending in a linear array along the length of internal longitudinal passageway 52.

Figure 4A:
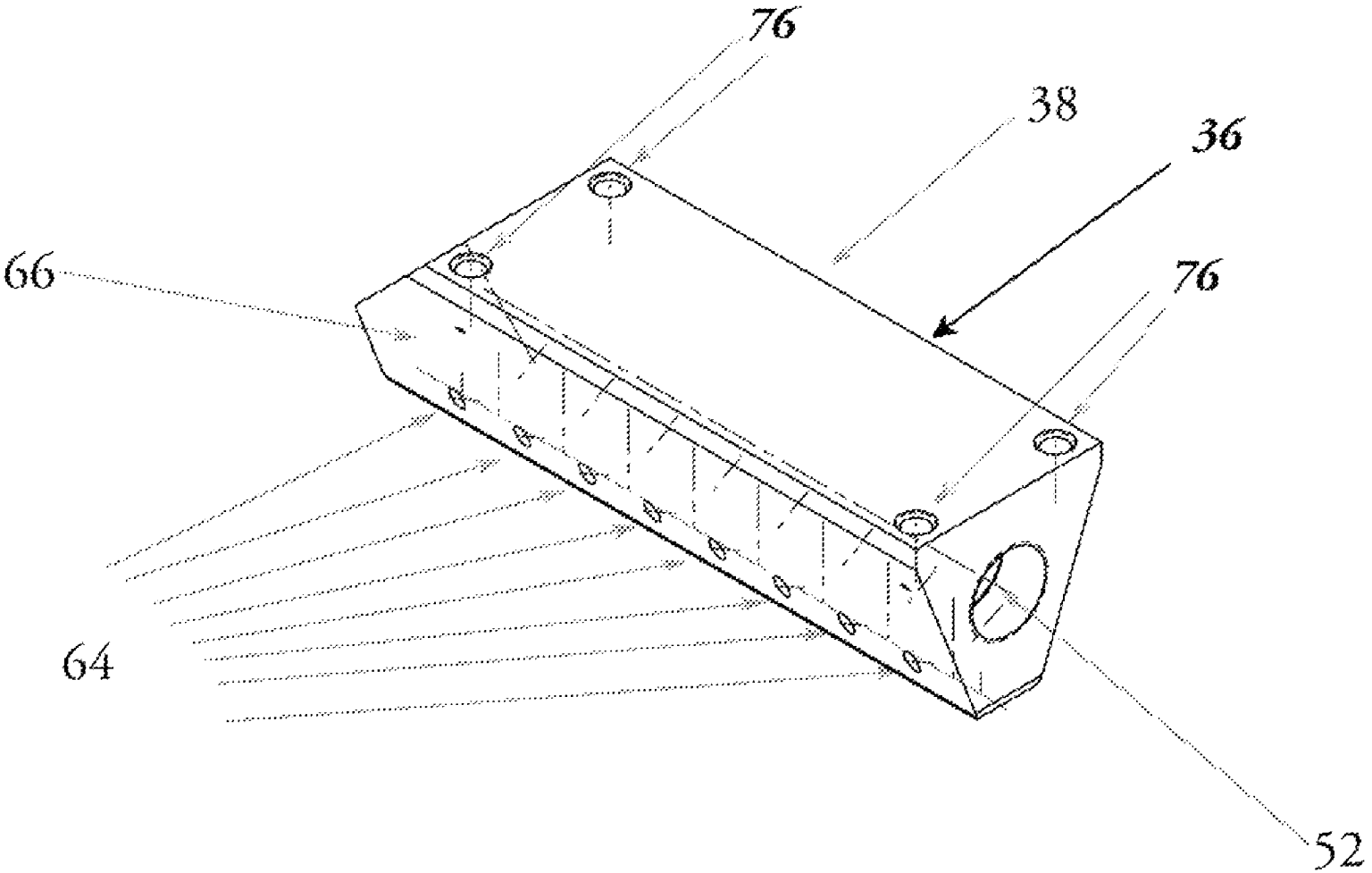
FIGS. 4A and 4B are schematic isometric perspectives illustrating the manifold block of an air knife.
Figure 4B:
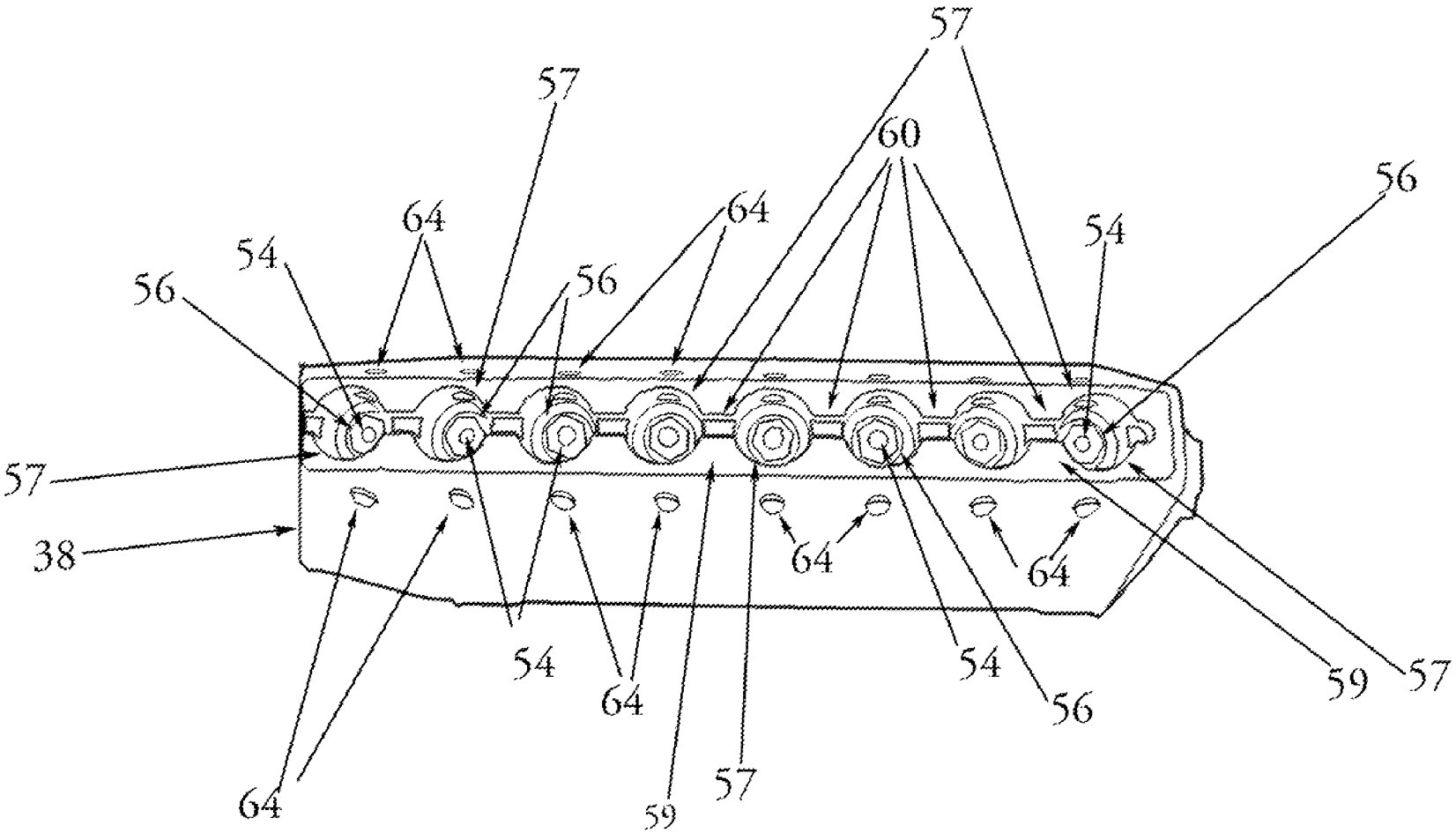
Figure 4C:
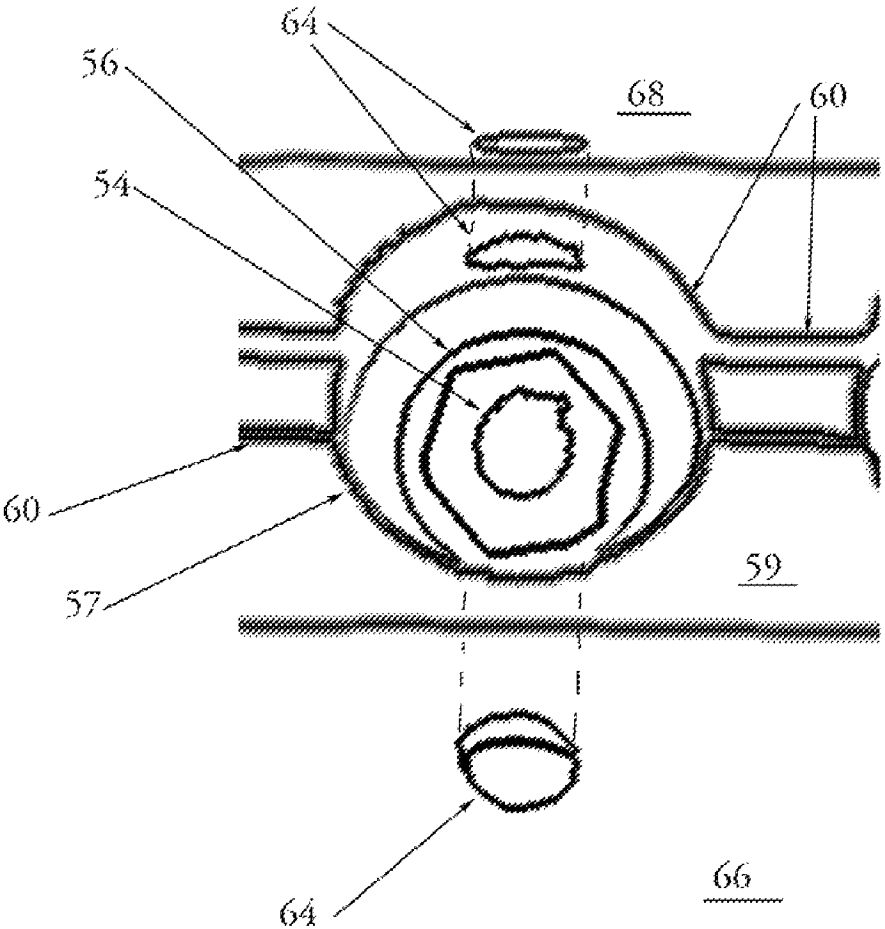
FIG. 4C is a detail of the region around a nozzle on the manifold block.
Figure 5:
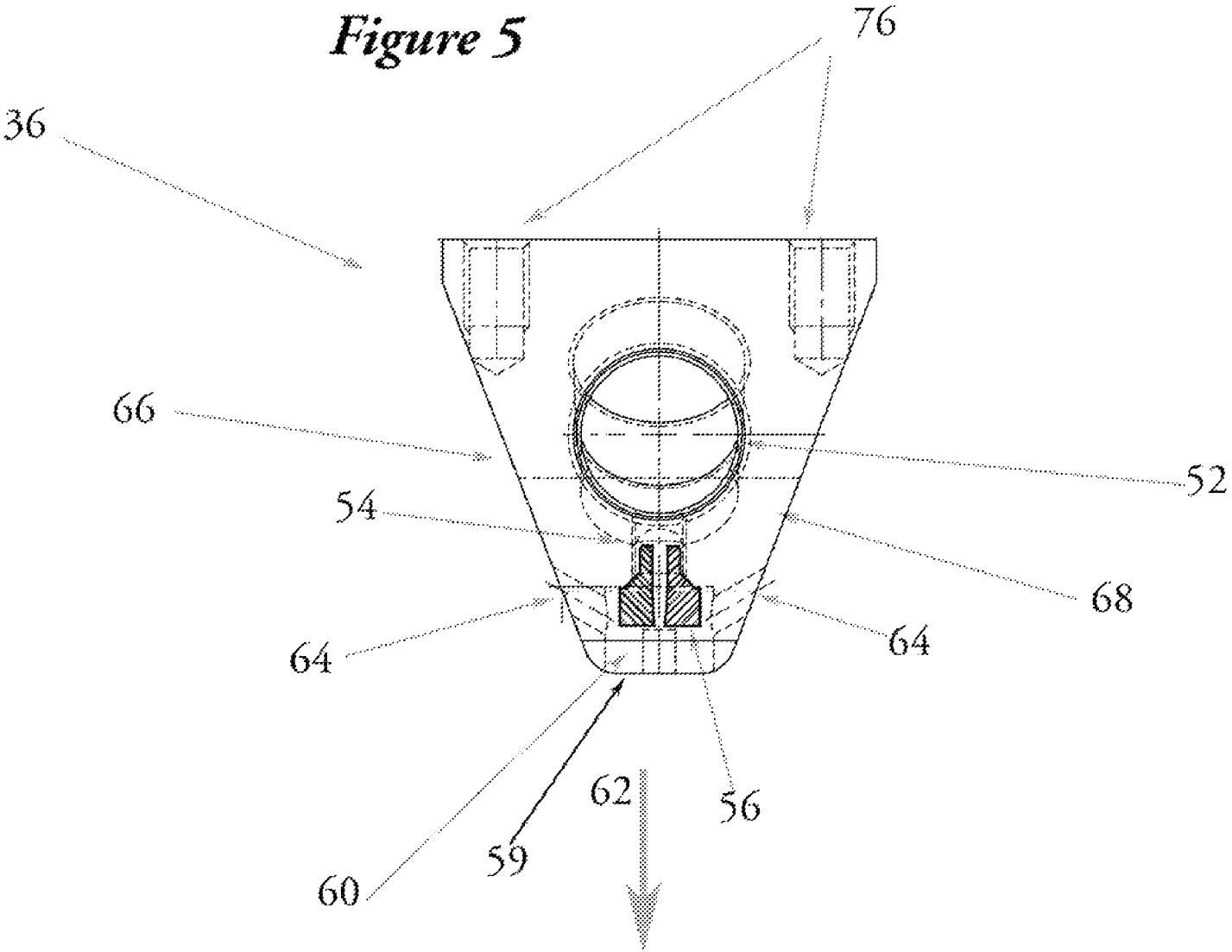
FIG. 5 is schematic sectional view illustrating the internals of the manifold block.
Figure 6:
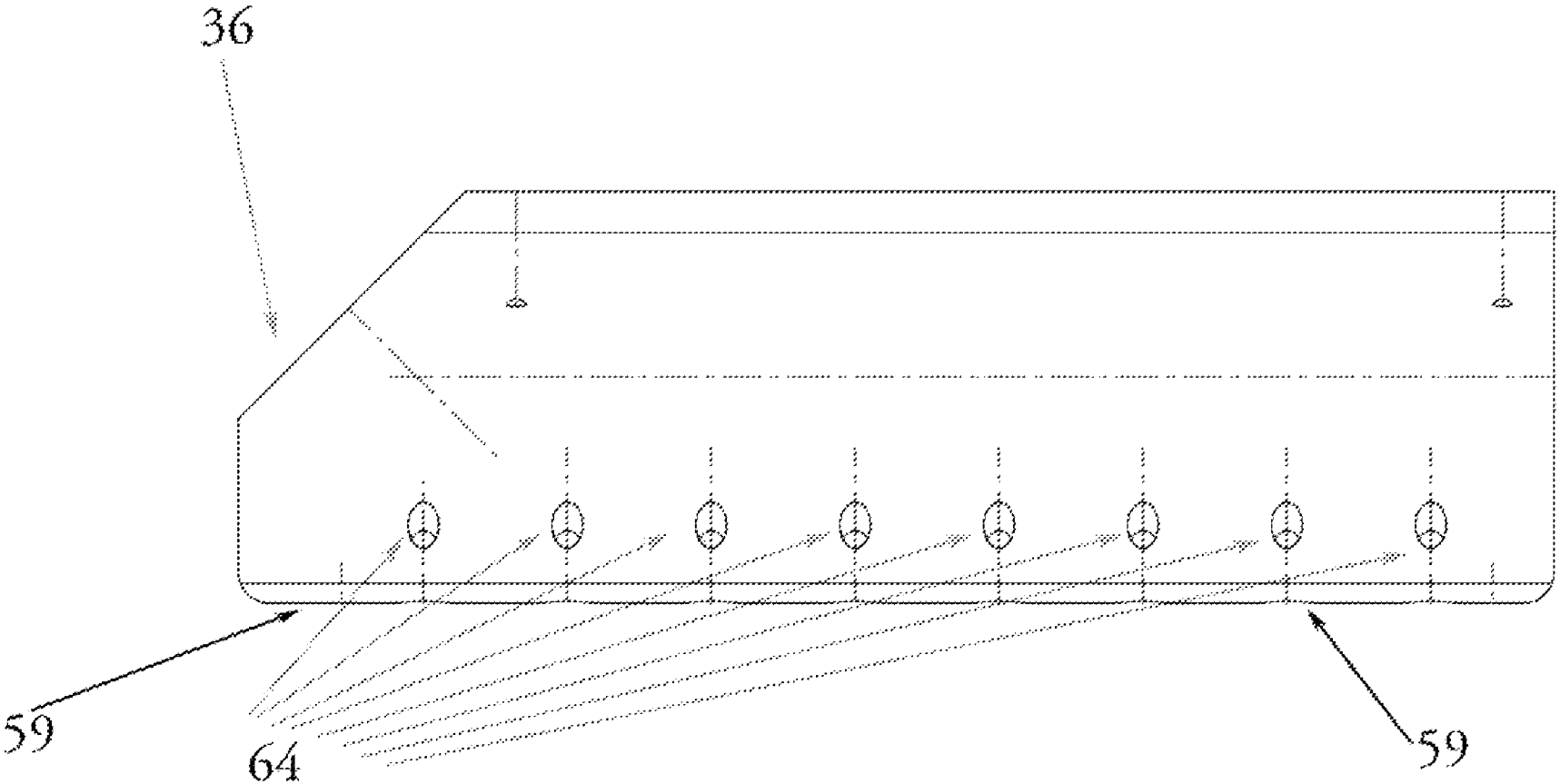
FIG. 6 is side view of the manifold block.
Figure 7:
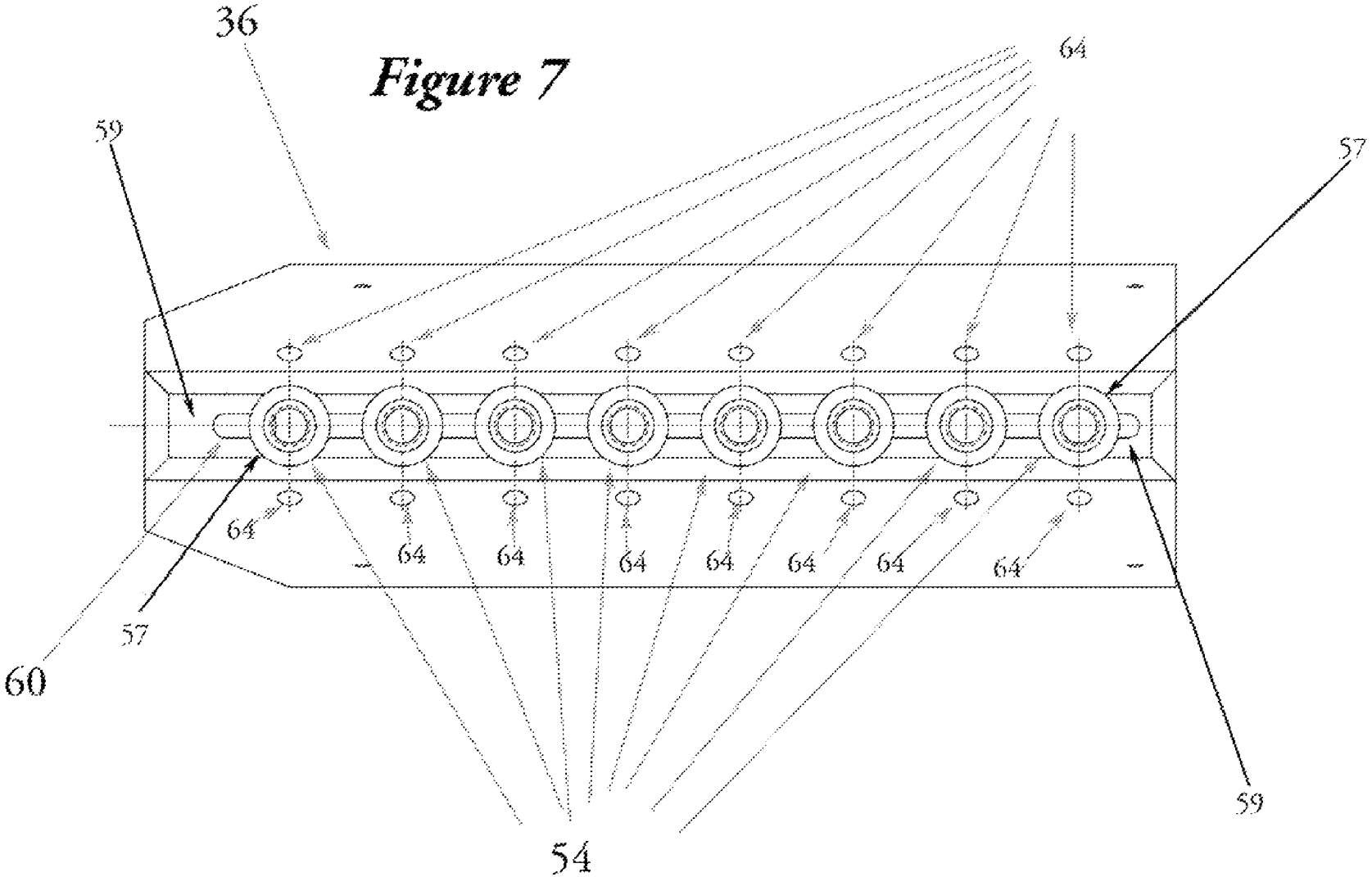
FIG. 7 is an elevational view of the working face of the manifold block.

In FIGS. 4A, 4B, 4C, 5, 6, and 7, particularly FIGS. 4A and 4B, nozzles 56, sited in enlarged recesses 57 and mounted in primary discharge passages 54, issue into longitudinally extending channel 60 connecting enlarged recesses 57 to each other. Discharge from nozzles 56 defines primary discharge direction 62 of air knife 38. Auxiliary orifices 64 extending to receding lateral faces 66 and 68 of manifold block 36 from longitudinally extending channel 60 are directed away from primary discharge direction 62 of air knife 38 preferably making at least an angle of at least about 90°, preferably 100° and still more preferably 120° with respect thereto. As nozzles 56 are recessed into enlarged recesses 57 and, preferably spaced at least about ¼ inch below face 59 of manifold block 36, if a portion or all of face 59 of manifold block 36 is occluded, air is free to flow around enlarged recesses 57 (having a diameter of about ⅝ inch) along longitudinally extending channel 60 having length of approximately 7 inches, depth and width of about ¼ inch, which thus provides very little resistance to flow of air therealong. In the extreme event that the entirety of face 59 of manifold block 36 is occluded, air is free to flow outwardly through auxiliary orifices 64 having a diameter of about 3/16 inch (0.1875 feet) and a length of slightly over 1/4 inch. As 16 auxiliary orifices are present, considerable effort (and most likely ingenuity as well) will normally be required to create excessive pressure at face 59 of manifold block 36, particularly as shield 50 (FIG. 1) restricts access to auxiliary orifices 64 on receding lateral faces 66 and 68 of manifold block 36.

Figure 3:
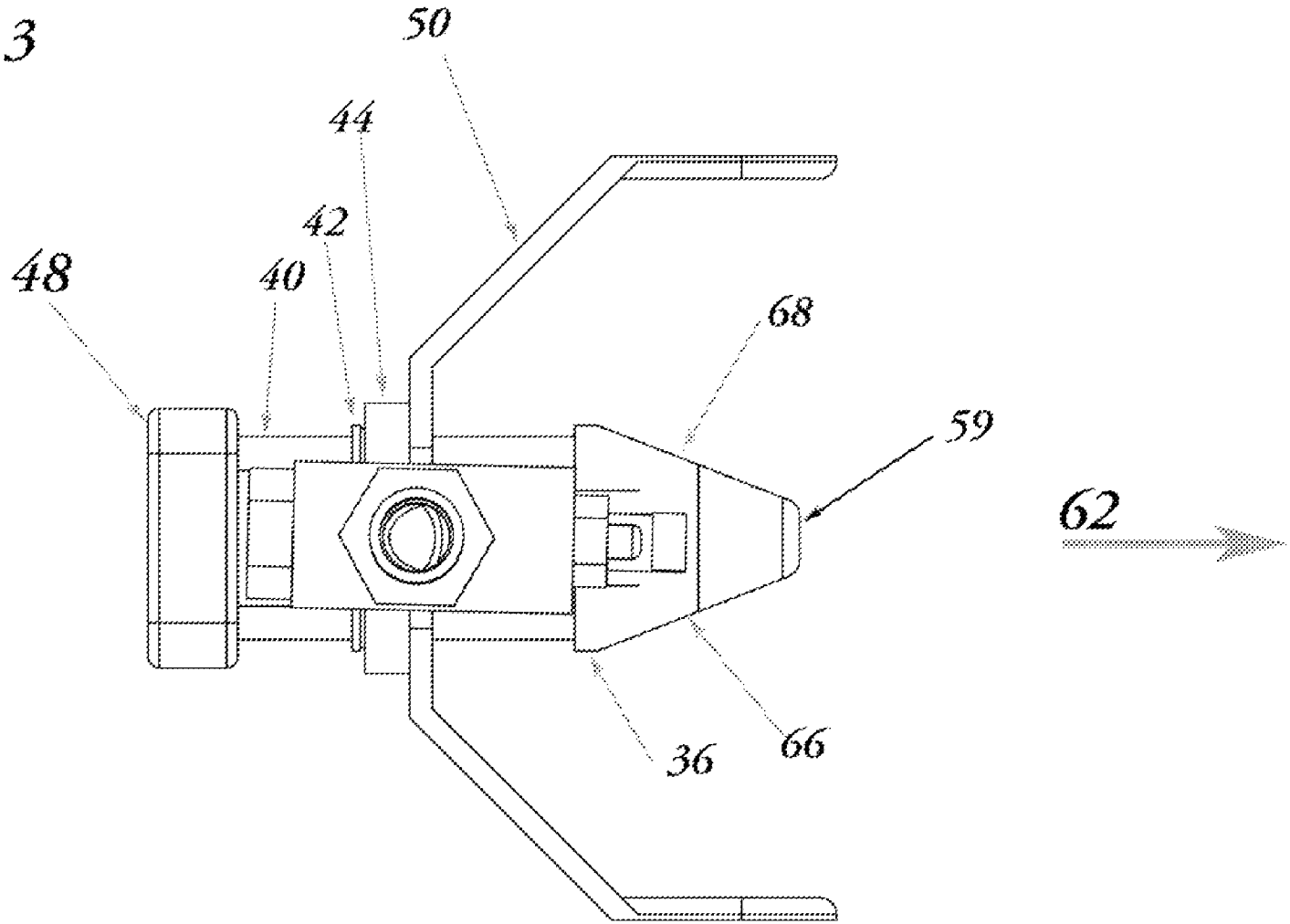
FIG. 3 is an end view of an air-knife.
Figure 8:
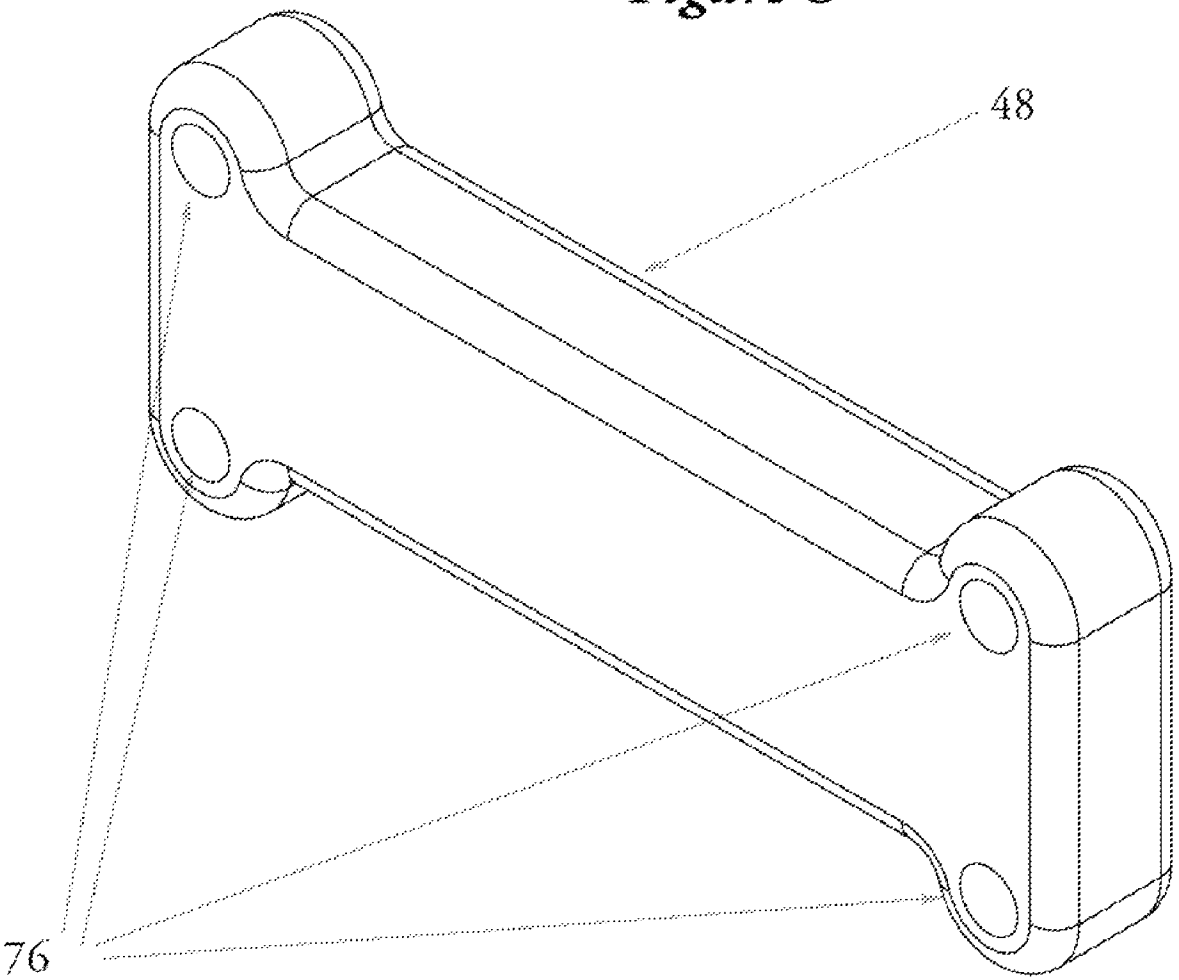
FIG. 8 is a schematic isometric perspective of the handle of an air knife.
Figure 9:
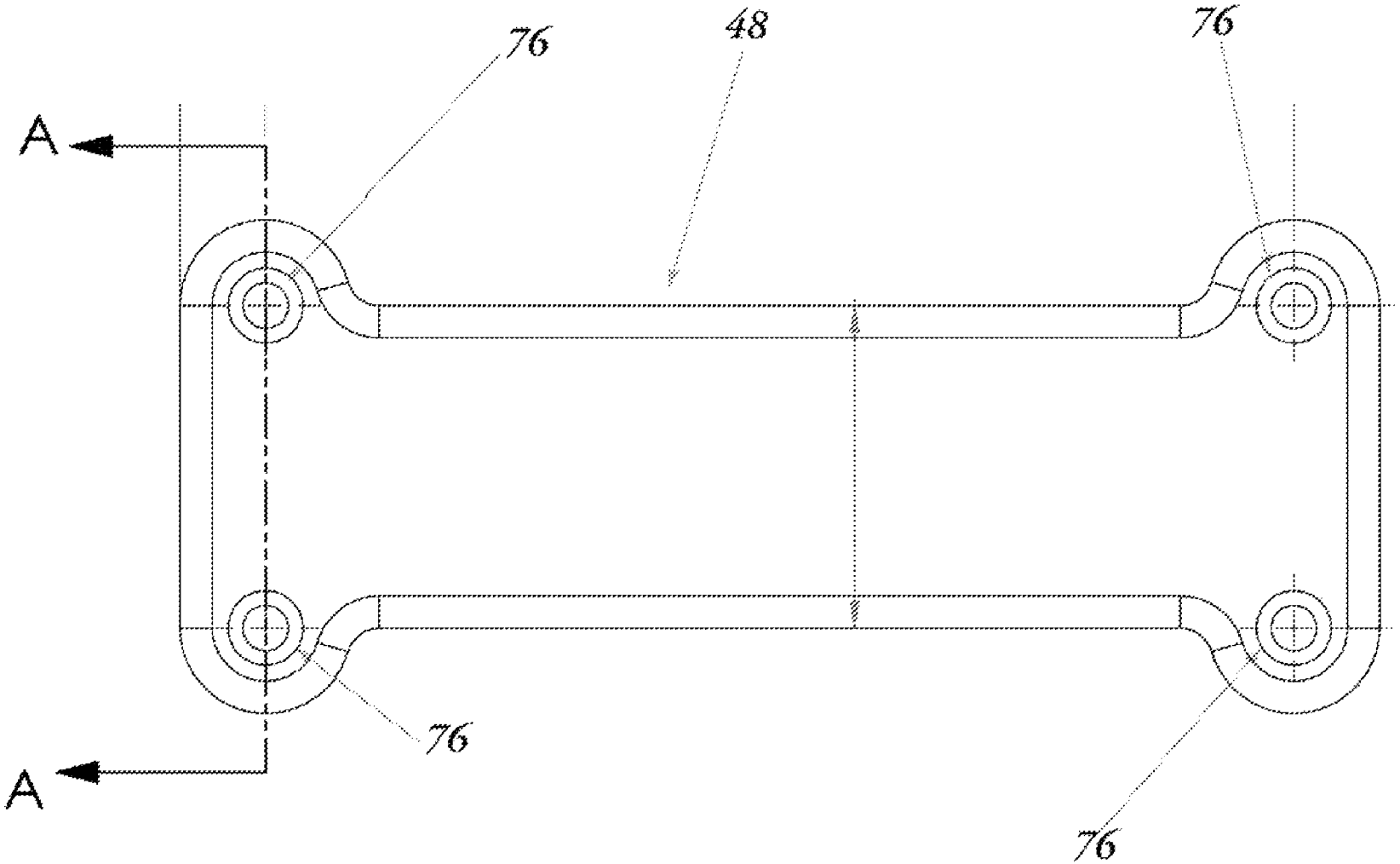
FIG. 9 is a plan view of the handle.
Figure 10:
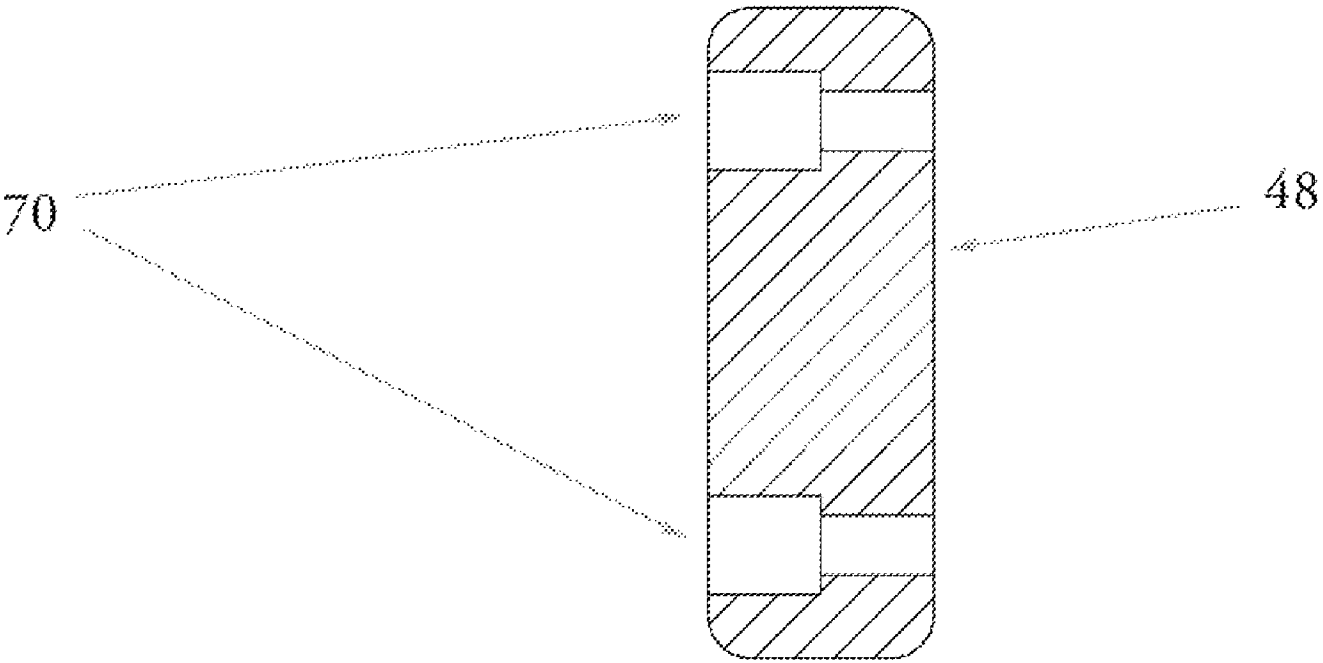
FIG. 10 is sectional view through the handle.

FIGS. 8, 9 and 10 illustrate the spring loaded mounting of handle 48 in which handle 48 has internal threads formed in receiving apertures 70 in into which upper ends of support rods 40 (FIGS. 1 and 2) may be secured. As illustrated in FIGS. 2 and 3, support rods 40 pass through journals 42 in pillow block 44 to which U shaped shield 50 is secured with lower ends of support rods 40 being secured into internally threaded receiving apertures 76 (FIGS. 4 and 5) manifold block 36. Springs (not shown) urge handle 48 away from pillow block 44.

Figure 11:
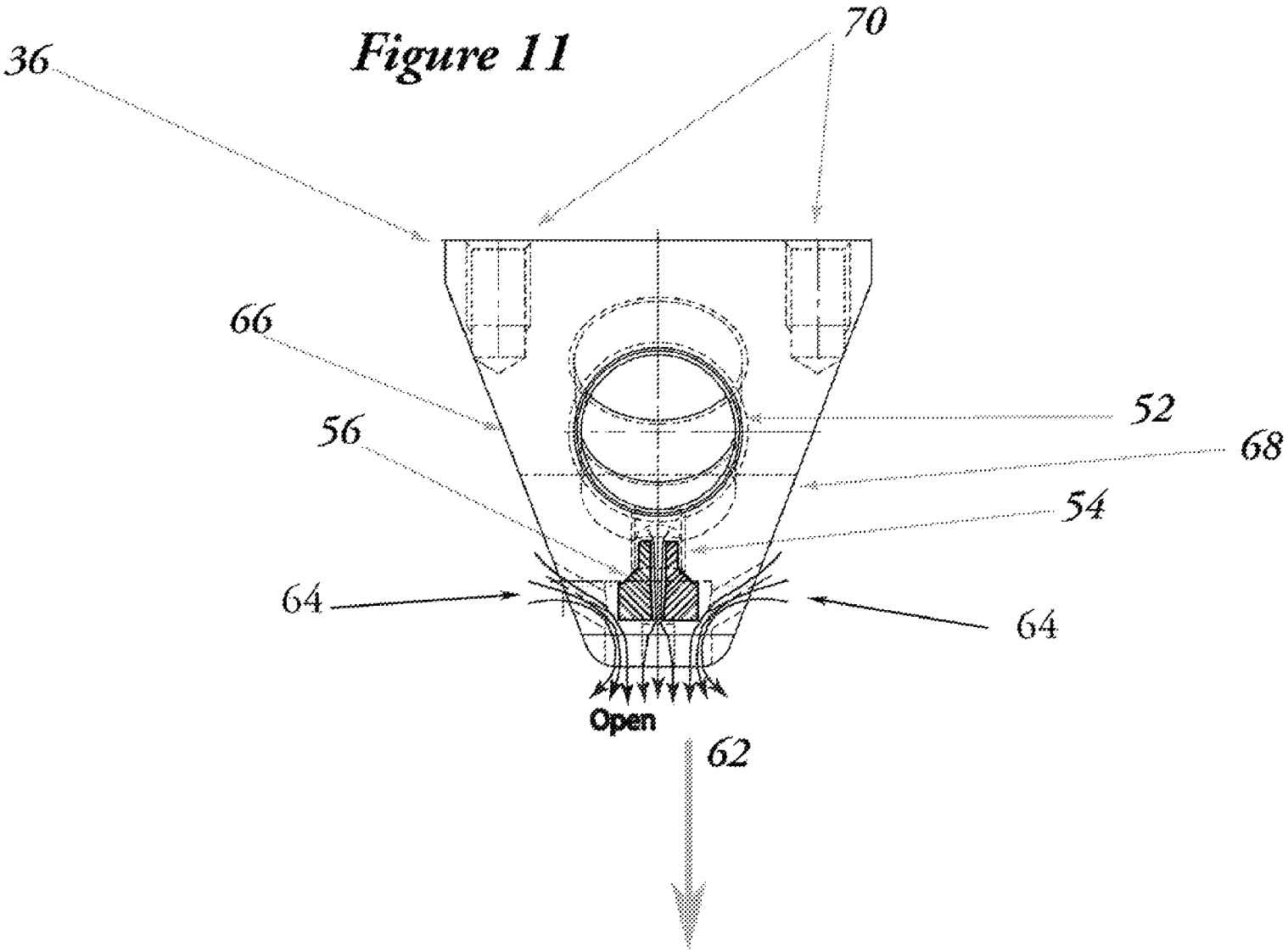
FIG. 11 is a sectional schematic through the nozzle illustrating air flow through the nozzle in normal operation.
Figure 12:
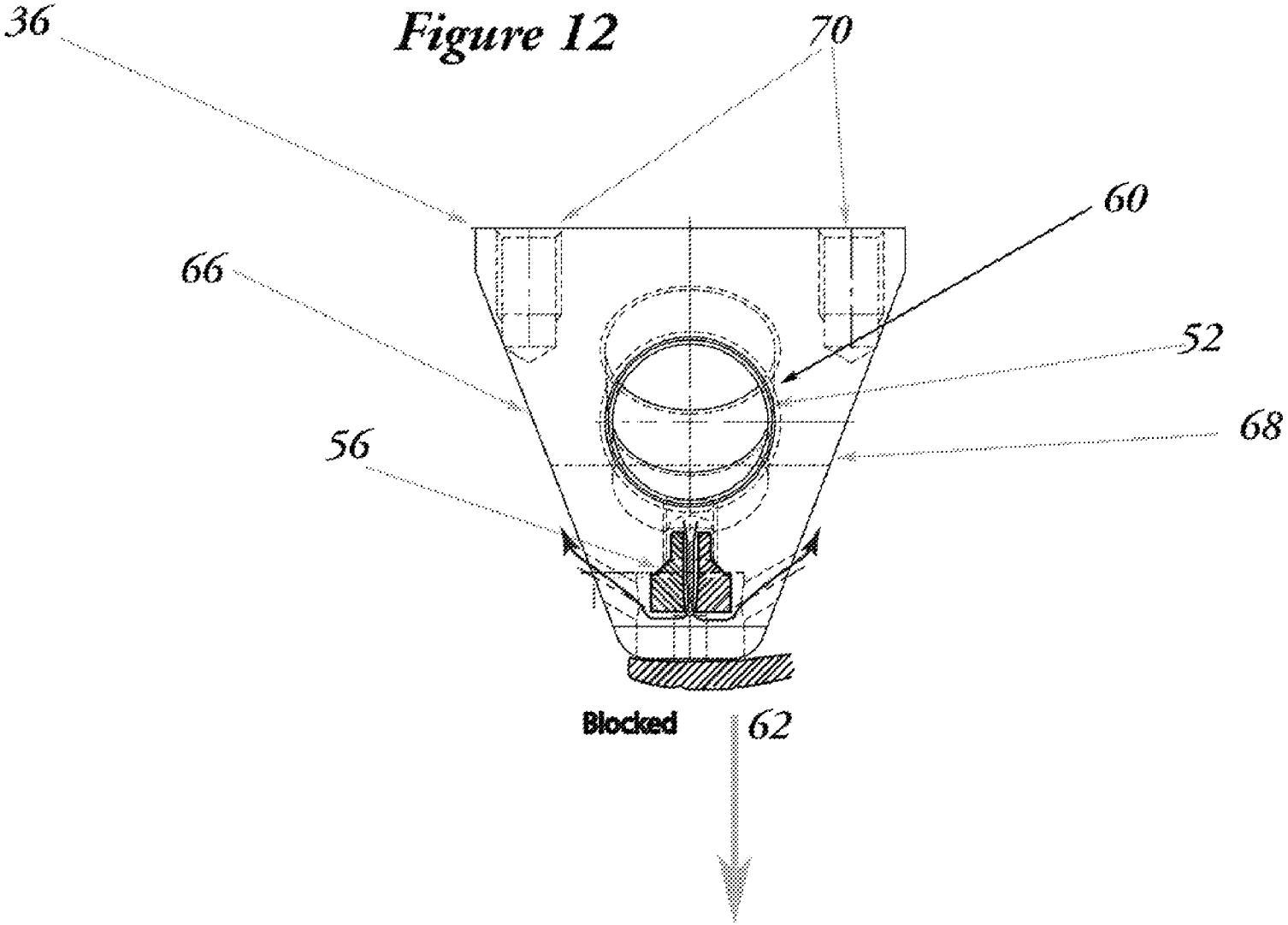
FIG. 12 is a sectional schematic through the nozzle illustrating air flow through the nozzle in the case where a blockage is present.
Figure 14:
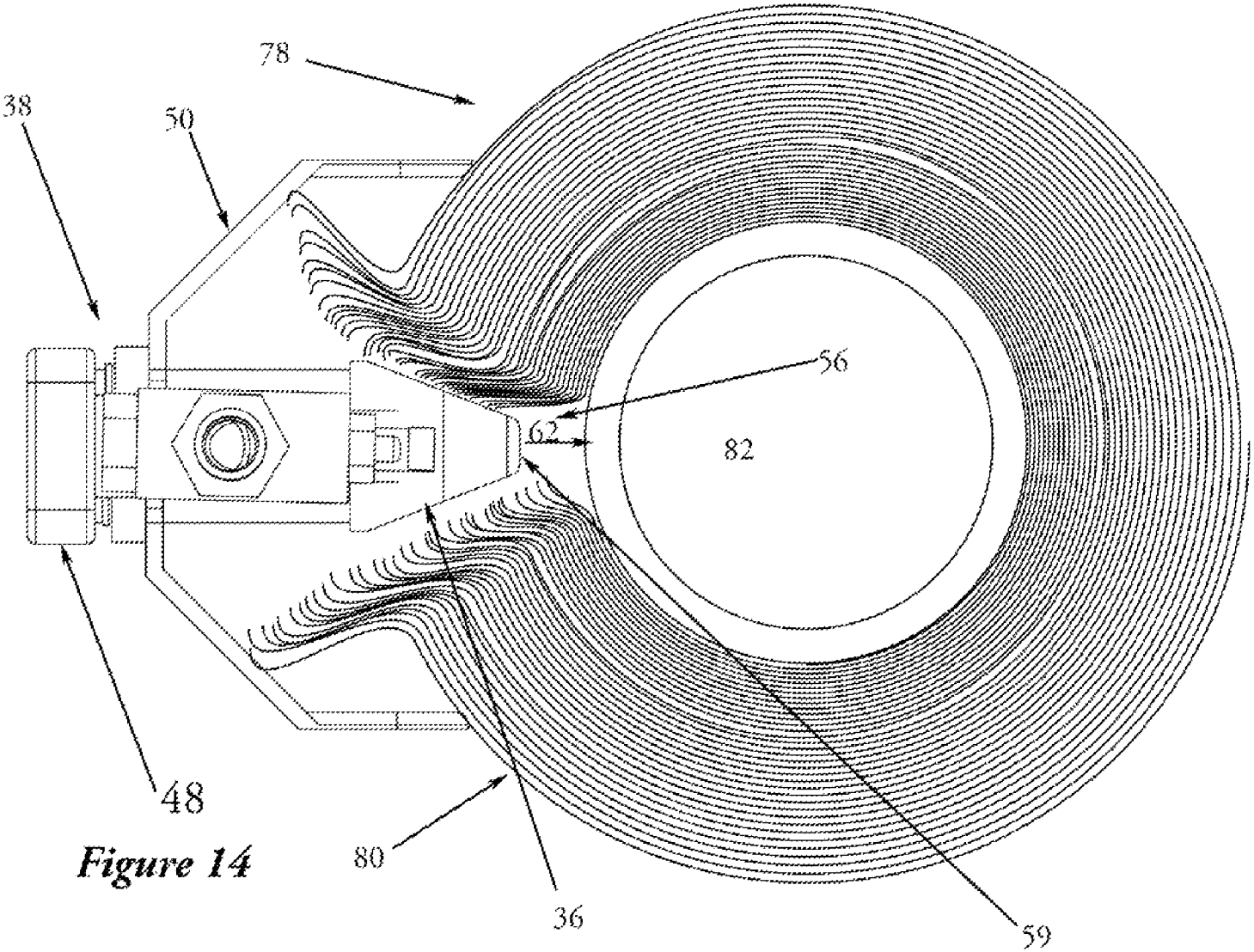
FIG. 14 is a schematic illustrating an air knife as it is extended into the layers of tissue remaining upon a stub roll.

Continuing with FIGS. 2 and 3, in normal operation, when control valve 32 is activated, air flows through manifold block 36 into nozzles 56 (FIG. 4B) and exits in primary discharge direction 62. The Venturi effect also draws a secondary flow of air inwardly through auxiliary orifices 64 as illustrated in FIG. 11. In the case where an obstruction is placed against manifold block 36 as illustrated in FIG. 12, the flow of air through nozzles 56 is redirected outwardly through longitudinally extending channel 60 preventing the pressure presented at the face of manifold block 36 from exceeding limits set by OSHA and/or other regulatory agencies. In the case of the present device constructed substantially to scale as illustrated in the Figures, air supply through a 3/4 inch line at 90 psig, results in a blocked pressure of only about 14 psig which is considerably below the OSHA allowable figure of 30 psig, yet the effective pressure delivered in use in the unblocked configuration is quite effective in quickly stripping away residual tissue perhaps a few inches in thickness, thus resulting both labor savings and materials savings as cores 82 stripped with air knife 38 (as illustrated in FIG. 14) may be recycled with effective lives far exceeding that of cores stripped with a blade such as a utility knife, box cutter or pocket knife. Preferably, at least four, more preferably at least six and most preferably at least eight collinear nozzles are used to enhance the speed of removal of paper from the core.

Figure 13:
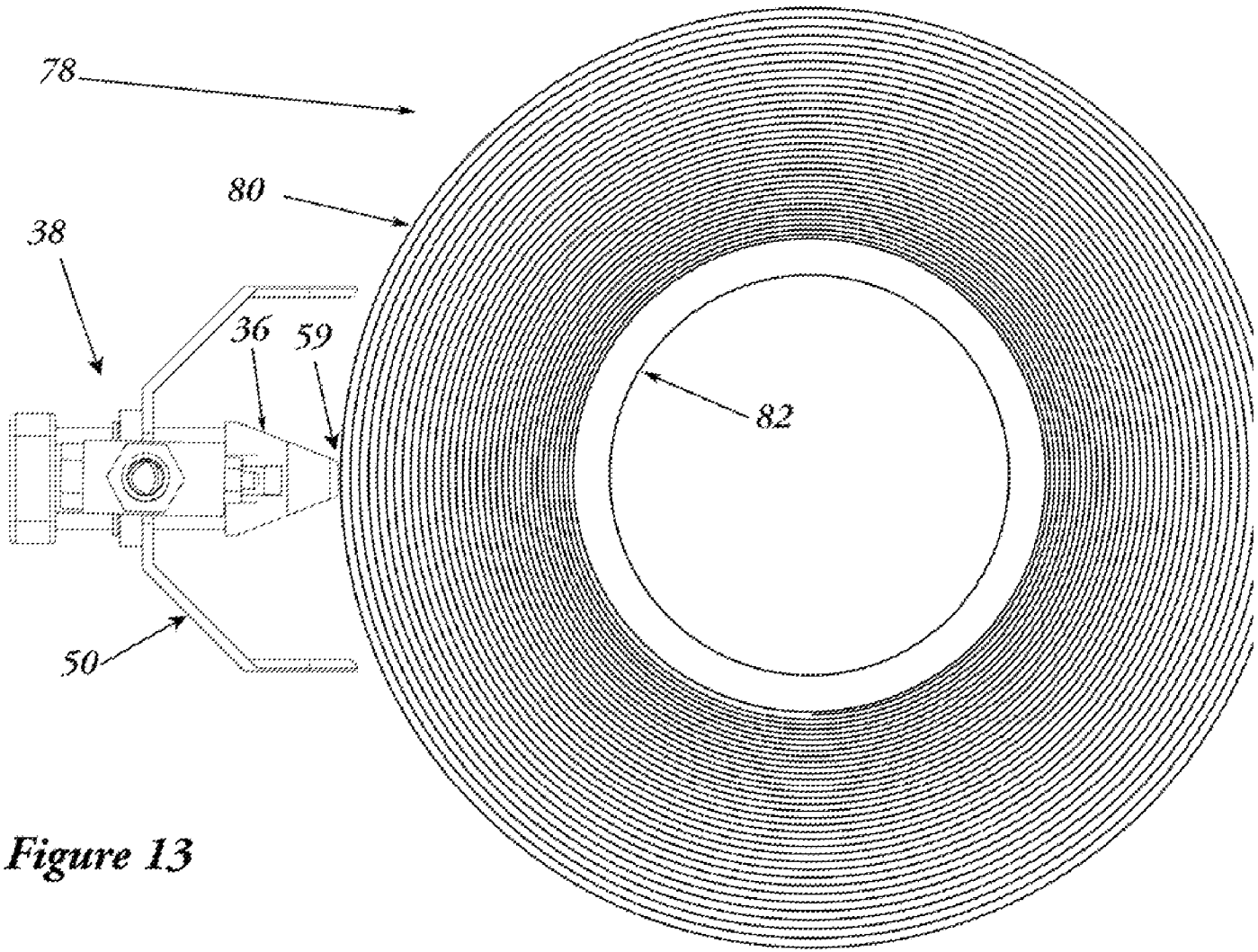
FIG. 13 is a schematic illustrating an air knife as it is first brought into engagement with a stub roll of tissue.

In FIG. 13, as air knife 38 is brought into engagement with stub roll 78 having only a small amount of residual tissue 80 remaining thereupon, perhaps 2 to 3 inches remaining from a roll originally several feet in diameter, perhaps 5 to 7 feet, shield 50 extends beyond face 59 of manifold block 36 until shield 50 comes into contact with residual tissue 80 remaining thereupon. As the operator urges air knife 38 against stub roll 78, shield 50 retracts as illustrated in FIG. 14, while layers of residual tissue 80 upon stub roll 78 are severed by the flow of air exiting through nozzles 56 (FIGS. 4B, 4C, 5 and 11) and are retained within shield 50 as air knife 38 presses further into residual tissue 80 remaining upon stub roll 78, finally leaving stub roll 78 stripped bare to core 82 of residual tissue 80. Retention of severed layers of residual tissue 80 within shield 50 reduces mess. As discussed previously, core 82 is not scratched, scored or weakened by the action of air knife 38 allowing it to be re-used repeatedly. Significantly, air knife 38 is configured such that two-handed operation is required as control valve 32 (FIG. 1) is spring loaded, requiring the user to hold it in the open position while grasping handle 48 to urge face 59 of manifold block 36 into engagement with residual tissue 80 on stub roll 78. This further guards against accidental contact between the user and excessive air pressure.

As my invention, I claim:

1. A roll stripping air knife comprising:

a. a manifold block having:

i. an internal longitudinal passageway defined therein;

ii. a working face having a longitudinally extending exterior channel formed therein;

iii. a plurality of primary discharge passages extending between said longitudinal air passageway and said longitudinally extending exterior channel and opening into said longitudinally extending exterior channel;

iv. a plurality of primary discharge orifices defined therein extending in a longitudinal linear array extending along the length of said manifold block, 1. each primary discharge orifice connecting with an associated discharge passage connecting with said longitudinal passageway, 2. each said orifice having means for mounting a removable discharge nozzle thereupon, and 3. each said primary discharge orifice being generally oriented and directed in a primary discharge direction;

v. a plurality of interconnected auxiliary orifices defined therein, each auxiliary orifice being generally directed laterally away from the primary discharge direction and connecting with said longitudinally extending exterior channel;

vi. a plurality of removable nozzles, one mounted on each primary discharge orifice; and b. means for controllably supplying pressurized air to said manifold block, said auxiliary orifices being configured such that air flows inwardly therethrough when pressurized air is supplied to said manifold block and said nozzles are unobstructed but outwardly when said nozzles are obstructed.

2. The roll stripping air knife of claim 1 further comprising: a shield retractably mounted on and laterally encompassing said manifold over an angle which is at least about 150° as measured from said nozzles in a retracted position, and at least about 200° in an extended position, said shield having a generally U-shaped cross-section opening generally in the primary discharge direction.

3. The roll stripping air knife of claim 2, wherein a control valve is spring loaded in the normally closed configuration and said shield is spring loaded in the normally extended configuration.

4. The roll stripping air knife of claim 3, wherein said shield defines a portion of the surface of a generalized cylinder having radiators generally parallel to the longitudinally extending channel.

5. The roll stripping air knife of claim 4, wherein: the longitudinally extending channel, auxiliary orifices, discharge passages, and nozzles are configured and provided in sufficient number that when compressed air at 90 psig is supplied to said internal longitudinal passageway and the longitudinally extending channel is occluded in the primary discharge direction, the resulting pressure in the longitudinally extending channel is no more than about 15 psig.

6. The roll stripping air knife of claim 4, wherein: the longitudinally extending channel, auxiliary orifices, discharge passages, and nozzles are configured and provided in sufficient number that when compressed air at 90 psig is supplied to said internal longitudinal passageway and the longitudinally extending channel is occluded in the primary discharge direction, the resulting pressure in the longitudinally extending channel is no more than about 20 psig.

7. The roll stripping air knife of claim 4, wherein: the longitudinally extending channel, auxiliary orifices, discharge passages, and nozzles are configured and provided in sufficient number that when compressed air at 90 psig is supplied to said internal longitudinal passageway and the longitudinally extending channel is occluded in the primary discharge direction, the resulting pressure in the longitudinally extending channel is no more than about 25 psig.

8. The roll stripping air knife of claim 1, wherein: the longitudinally extending channel, auxiliary orifices, discharge passages, and nozzles are configured and provided in sufficient number that when compressed air at 90 psig is supplied to said internal longitudinal passageway and the longitudinally extending channel is occluded in the primary discharge direction, the resulting pressure in the longitudinally extending channel is no more than about 15 psig.

9. The roll stripping air knife of claim 1, wherein at least four nozzles are provided, each recessed from the working face of said manifold block by at least about ¼ inch.

10. The roll stripping air knife of claim 1, wherein at least four nozzles are provided, each recessed from the working face of said manifold block by at least about ⅛ inch.

11. The roll stripping air knife of claim 1, wherein at least eight auxiliary orifices are provided, each recessed from the working face of said manifold block by at least about ⅛ inch.

12. The roll stripping air knife of claim 1, wherein at least eight auxiliary orifices are provided, the axis of each being recessed from the working face of the manifold block by a distance which is less than the distance by which said nozzles are recessed.

* * * * *